United States Patent [19]

Gehly et al.

[11] Patent Number: 5,067,064

[45] Date of Patent: Nov. 19, 1991

[54] PATTERN CHANGE MECHANISM

[75] Inventors: Joel C. Gehly, McKean; David Zolner, Fairview; James M. Szumigala, Erie, all of Pa.

[73] Assignee: American Sterilizer Company, Erie, Pa.

[21] Appl. No.: 495,253

[22] Filed: Mar. 16, 1990

[51] Int. Cl.[5] ..... F21V 13/02

[52] U.S. Cl. ..... 362/277; 342/33; 342/321; 342/283; 342/346; 342/309; 342/804

[58] Field of Search ..... 362/277, 281, 283, 284, 362/290, 319, 321, 322, 323, 324, 325, 332, 328, 339, 346, 342, 804, 308, 309; 350/611, 616

[56] References Cited

U.S. PATENT DOCUMENTS

| | | | |
|---|---|---|---|
| 2,695,547 | 11/1954 | Zander | 362/321 |
| 3,927,313 | 12/1975 | Herold | 362/33 |
| 4,015,113 | 3/1977 | Gottschalk | 362/217 |
| 4,288,844 | 9/1981 | Fisher et al. | 362/33 |
| 4,617,619 | 10/1986 | Gehly | 362/302 |
| 4,622,625 | 11/1986 | Becker et al. | 362/297 |
| 4,651,257 | 3/1987 | Gehly et al. | 362/33 |
| 4,800,473 | 1/1989 | Tremblay | 362/325 |
| 4,811,182 | 3/1989 | Solomon | 362/321 |

FOREIGN PATENT DOCUMENTS

| | | | |
|---|---|---|---|
| 268049 | 3/1927 | United Kingdom | 362/321 |

*Primary Examiner*—Carl D. Price
*Assistant Examiner*—D. M. Cox
*Attorney, Agent, or Firm*—Kirkpatrick & Lockhart

[57] ABSTRACT

A pattern change mechanism is provided for use with a lighting fixture. The mechanism includes a plurality of blocking members for blocking light directed by the reflector of the lighting fixture toward a target surface, means for moving the blocking members to achieve small, medium and large patterns of light on the target surface. The moving means includes a rotation member, drive means, actuator means linked to the blocking members and a handle for rotating the rotation member to thereby effect movement of the blocking members through the drive means and actuator means.

19 Claims, 7 Drawing Sheets

PATTERN CHANGE MECHANISM

BACKGROUND OF THE INVENTION

1. Field of the Invention

The present invention relates to lighting fixtures, and more particularly to means for changing lighting patterns.

2. Description of the Prior Art

In the specialized lighting utilized for surgical procedures, it is frequently desirable to be able to adjust the pattern size of the light pattern on the wound site depending upon the particular procedure being used and/or the progress of the operation during the surgical procedure.

The conventional means of accomplishing a change in focus and/or a change in pattern size is by mechanical movement of the bulb relative to the reflector or reflectors of the optical system. This normally involves utilization of a lever or levers located on the light itself in order to initiate physical lamp source displacement. Fischer et al., U.S. Pat. No. 4,288,844, issued on Sep. 8, 1981 discloses a means for controlling pattern size and/or focus of surgical lighting.

Prior approaches to improving surgical lighting have generally relied on increasing the size of the lighting fixture or the number of light sources. For example, Herold U.S. Pat. No. 3,927,313 discloses a surgical lighting fixture having several individual light sources event arranged around a central axis. A problem with conventional multiple source lightheads however, is that they product multiple shadows when the beams are interrupted.

Single source lightheads eliminate the problem of multiple shadows but do not provide both high intensity and a large pattern of illumination. To achieve the desired intensity, the pattern of illumination must be limited or the wattage of the bulb increased. The achieve a large pattern, the intensity is reduced. Single source surgical lightheads generally offer their best characteristics at a pattern no greater than six inches and an intensity no greater than 6,000 foot candles.

In some applications, for example, cardiovascular surgery, a larger pattern of illumination is preferred. In Europe, the trend is to couple larger surgical lights to provide a larger illumination pattern with a smaller light of greater intensity to pinpoint a critical area.

Where one lighting fixture is used for a variety of applications, those requiring high intensity and those requiring a large pattern, the lighting fixture should be adjustable to accommodate different needs. Several commercially available lighting fixtures provide some adjustability by means of altering the position of the entire lighting fixture relative to the work surface or by means of complicated light source positioning. For example, by altering the distance between the light source and the reflector in the lighting fixture, the pattern size and intensity can be varied.

Gehly et al., U.S. Pat. No. 4,651,257 issued on Mar. 17, 1987 discloses a multiple lighting apparatus designed to reduce shadows while providing a large field of intense illumination. The light rays projected from the reflector converge at an acute angle relative to the axis of symmetry of the lighting apparatus, crossing that axis, to produce a single beam.

Gehly et al., U.S. Pat. No. 4,617,619 issued on Oct. 14, 1986 describes a lighting apparatus having a multiple reflector system which permits the pattern and intensity of illumination to be adjusted by rotation of one of the reflectors.

Several commercially available lighting fixtures include mechanisms for adjusting pattern size. Most of those systems are controlled by persons other than the surgeon or individual working under the light. Many of the conventional systems change the pattern size only at the expense of optical performance. Light intensity and depth of field are often sacrificed.

There is a need for a lighting fixture having a pattern change mechanism which is easily operated by the person using the light. There is a further need for such a pattern change mechanism which will selectively alter the area of light distribution without significantly altering the optical performance of the lighting fixture.

SUMMARY OF THE INVENTION

The present invention provides an apparatus for changing the size distribution of light emitted from a lighting fixture. The lighting fixture is of the type having a light source and a reflector superposing the light source in a partially circumscribing radially spaced relationship relative to the axis of symmetry of the lighting fixture for intersecting light radiating from the light source and directing the light toward a target surface.

The apparatus of the present invention includes means preferably a plurality of blocking members, for blocking light directed toward a target surface and means for moving the blocking means into at least a first position and a second position wherein, in the first position, no light is blocked to produce a first or large, pattern of light distribution, and wherein, in the second position, a first portion of light directed toward the target surface is blocked to produce a second or medium, pattern of light distribution smaller than the first pattern.

The moving means is preferably structured to move the blocking means into a third position wherein a second portion of light directed toward the target surface, greater than the first portion of light, is blocked to produce a third, or small, pattern of light distribution smaller than the second pattern.

The moving means may include a rotation member, drive means operatively connected to the rotation member and actuator means operatively linked to the blocking means and configured for sliding cooperation with the drive means. The rotation member is configured to slidably receive the actuator means. The moving means also includes means, such as a rotatable handle, for rotating the rotation member such that the rotation member effects the movement of the drive means and the drive means effects the sliding movement of the actuator means relative to the rotation member to selectively move the blocking means into one of the first, second or third positions.

The moving means may also include means for limiting the angle through which the rotation member can rotate. Such a limiting means may include bearing means operatively connected to the rotation member and track means for slidably mounting the bearing means. The track means defines a path having first and second ends along which the bearing means travels when the rotation member is rotated such that the rotation member is prevented from further rotation in a given direction when the bearing means reaches one of the first or second ends of the path. When the blocking means is in the first position, the bearing means is positioned at the first end of the path. When the blocking means is in the third position, the bearing means is positioned at the second end of the path.

Means, such as a detent, may be provided for locking the blocking means in one of the first, second or third positions. The blocking means may also be movable among the first, second and third positions in gradual degrees to produce gradually changing patterns of light distribution within a range of patterns from the first pattern to the third pattern.

The lighting apparatus with which the pattern change mechanism of the present invention is used preferably includes a refractor having a plurality of substantially equal, adjacent portions which radiate outwardly relative to the axis of symmetry and define in between each of the adjacent portions, a line of intersection. When the blocking members of the pattern change mechanism are in the fully open, first position, a different one of the blocking members is aligned above, and lies in the same plane as, each of the lines of intersection. When the blocking members are in the second or third positions, the blocking members are aligned at angles relative to the lines of intersection thereby blocking light from passing through selected areas of each portion of the refractor.

BRIEF DESCRIPTION OF THE DRAWINGS

In order that the present invention may be easily understood and readily practiced, a preferred embodiment will now be described by way of example only, in conjunction with the following figures wherein.

DETAILED DESCRIPTION OF THE PREFERRED EMBODIMENTS

Figure 1:
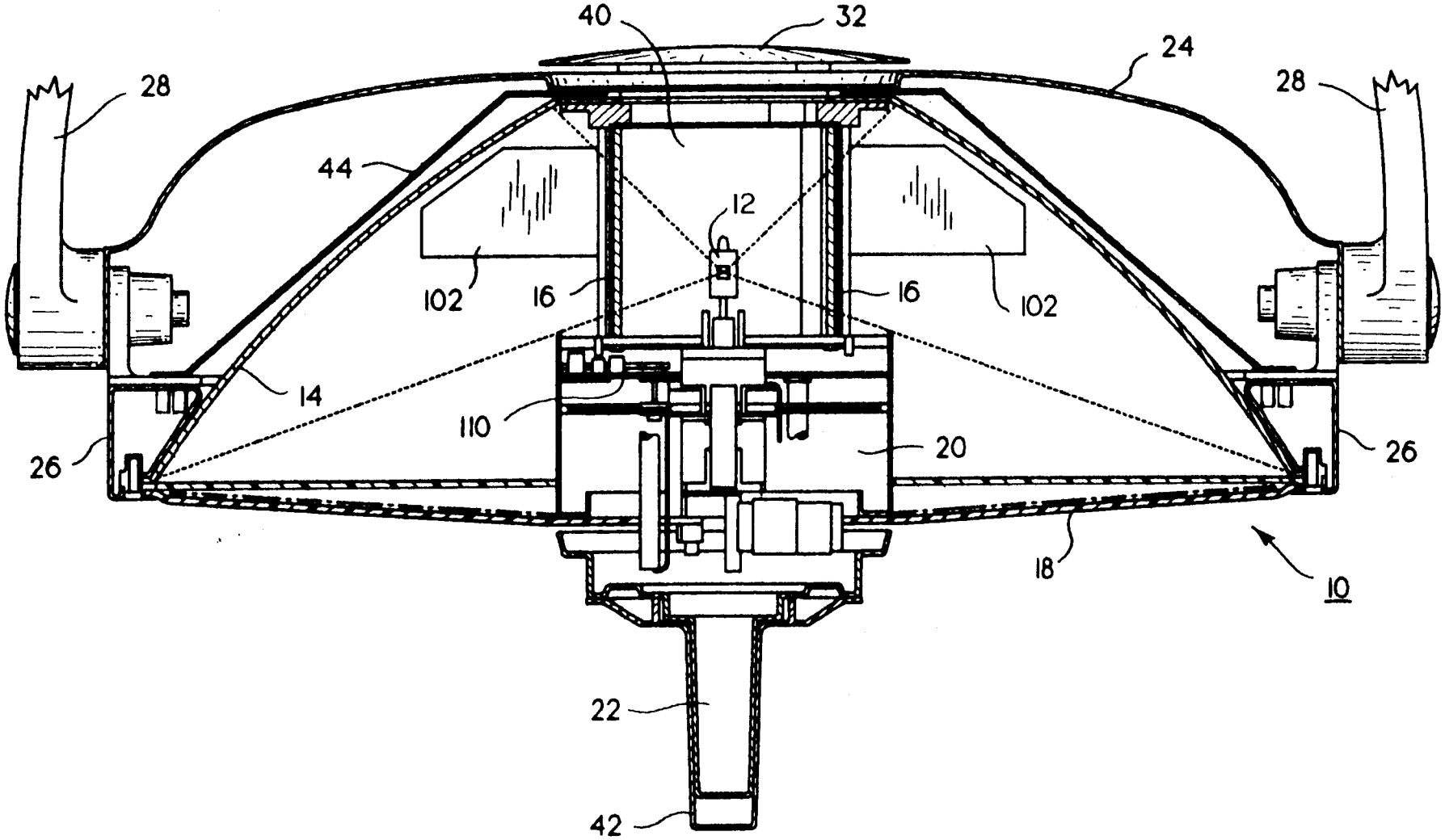
FIG. 1 is a front elevation section view of a preferred embodiment of the lighting fixture in which the pattern change mechanism of the present invention is used.

FIGS. 1-10 illustrate the preferred embodiment of the lighting fixture 10 having a pattern change mechanism 110 of the present invention. Lighting fixture 10 includes generally a light source means, or lamp 12, a reflector 14, a cylindrical filter 16, a refractor 18, a center core 20 for housing control mechanisms, such as the pattern change mechanism 110, and a handle 22.

A reusable, removable sterilizable handle cover 42, preferably made of a polyetherimide plastic is provided to slide over handle 22. A light fixture housing 24 preferably made of hydroformed aluminum, is provided to protect and cover the reflector 14 and the light fixture's electronics. A blow molded plastic structural ring provides a bottom support 26 for holding the edges of the reflector 14 and refractor 18. A brace member 44 joins housing 24, bottom support 26 and reflector 14. A support 28, preferably made of structural aluminum, connects the lighting fixture 10 to a suspension system (not shown). The lighting fixture 10 pivots about the horizontal axis between bolts 30 of each support 28. An easily removable cap assembly 32 is provided to permit access to the optical core 40 for cleaning and servicing filter 16 and lamp 12.

A more detailed description of lighting fixture 10, refractor 18 and the optical system provided thereby is disclosed in the co-pending commonly owned U.S. patent application of Gehly et al. for "Optical System For Lighting Fixture", filed simultaneously herewith, the complete disclosure of which is hereby incorporated herein by reference.

Figure 5:
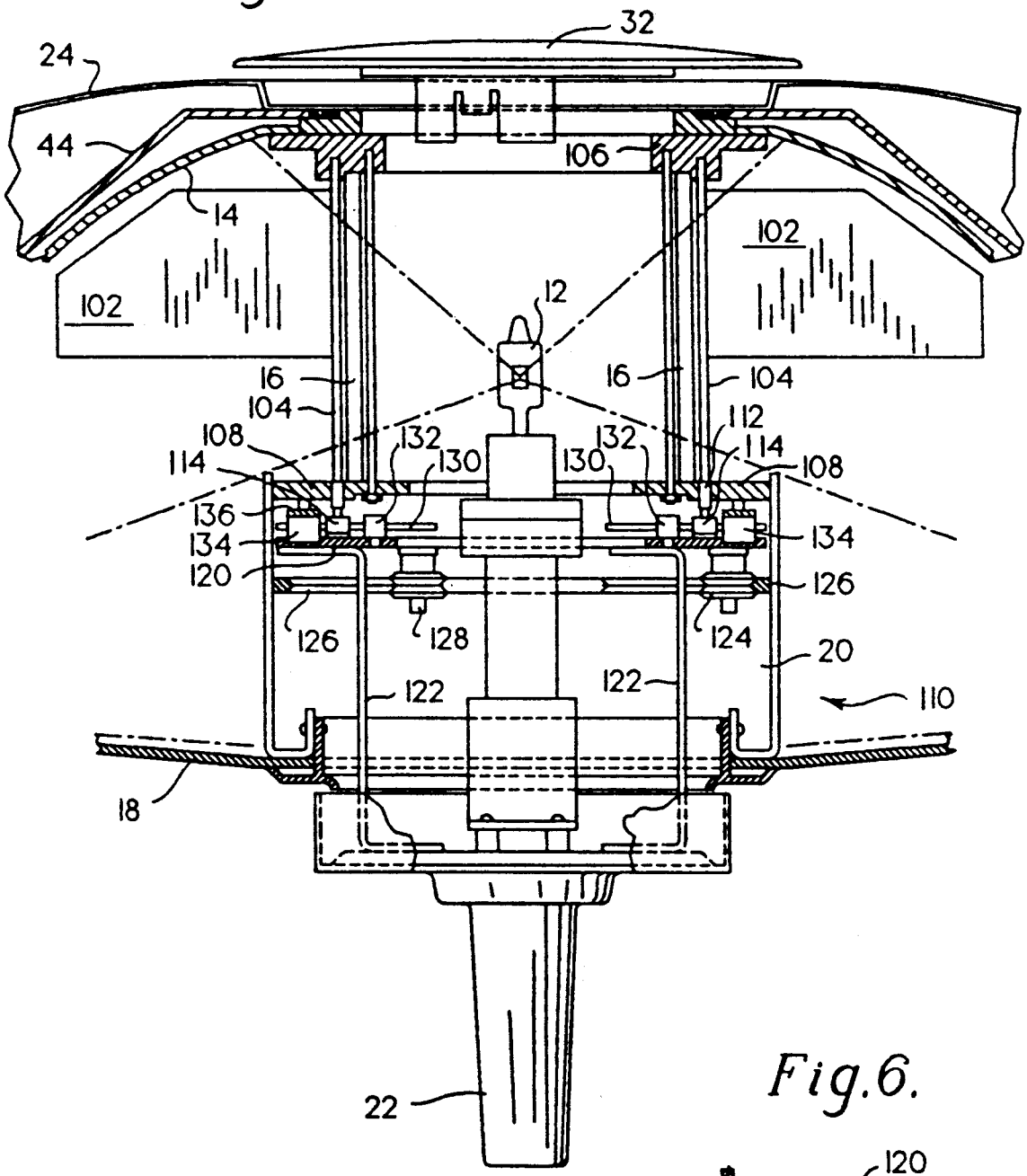
FIG. 5 is an enlarged section view of the lighting fixture of FIG. 1 showing the drive mechanism for the pattern change mechanism of FIG. 2.

In order to change the pattern of light in the optical system of lighting fixture 10, a pattern change mechanism, generally designated 110, is provided. Referring to FIG. 5, pattern change mechanism 110 includes a plurality of blocking members, or flags 102, preferably eight, rotatably mounted by rod 104 to an upper casting 106, through a hole in lower support plate 108, to a fixed actuator guide 114. A bearing 112, preferably an oilite bearing, surrounds rod 104 in the hole of support plate 108 and assures smooth rotation of rod 104 at that site.

Pattern change mechanism 110 also includes a rotation plate 120 operatively connected to handle 22 by support rods 122. A means for limiting the angle through which the rotation member 120 can rotate is provided by a plurality of vee-bearings 124, preferably three, which ride defined paths in a fixed track 126. Each vee-bearing 124 is connected by any suitable known means, such as a screw or bolt 128, to rotation plate 120. Each path of track 126 has a first end 123 and a second end 125. Two drive actuators 130 are attached to rotation plate 120 on opposite sides thereof through a bushing 132. Each drive actuator 130 has a flag 102 connected thereto by means of an actuator guide 114. Each drive actuator 130 slides through a complementary opening in an actuator arm 134.

There is one actuator arm 134 associated with each actuator guide 114 and flag 102. Each actuator arm 134 rides in a groove of rotation plate 120 and is operatively linked to the other actuator arms 134, and consequently to each flag 102, by means of link plate 136.

Figure 6:
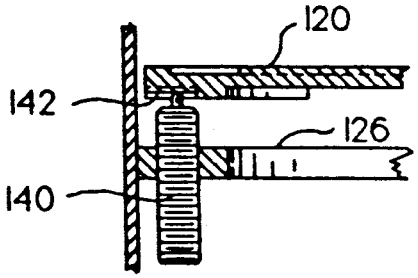
FIG. 6 is a partial section view of the detent mechanism of the pattern change mechanism of FIG. 5.

A spring plunger 140, shown in FIG. 6 is mounted in track 126 to provide a means for locking the pattern change mechanism into position. Plunger 140 engages a recess 142 in rotation plate 120.

In operation, manual rotation of handle 22 causes the rotation of rotation plate 120 which in turn causes the drive actuators 130 to move. Movement of the drive actuators 130 moves their associated actuator arms 134 along the groove of rotation plate 120. Due to the operative connection of all the actuator arms 134 by means of link plate 136, the movement of the actuator arms 134 associated with drive actuators 130 causes the corresponding, synchronous movement of all actuator arms 134 and their associated actuator guides 114. Movement of guides 114 causes flags 102 to rotate.

Figure 2:
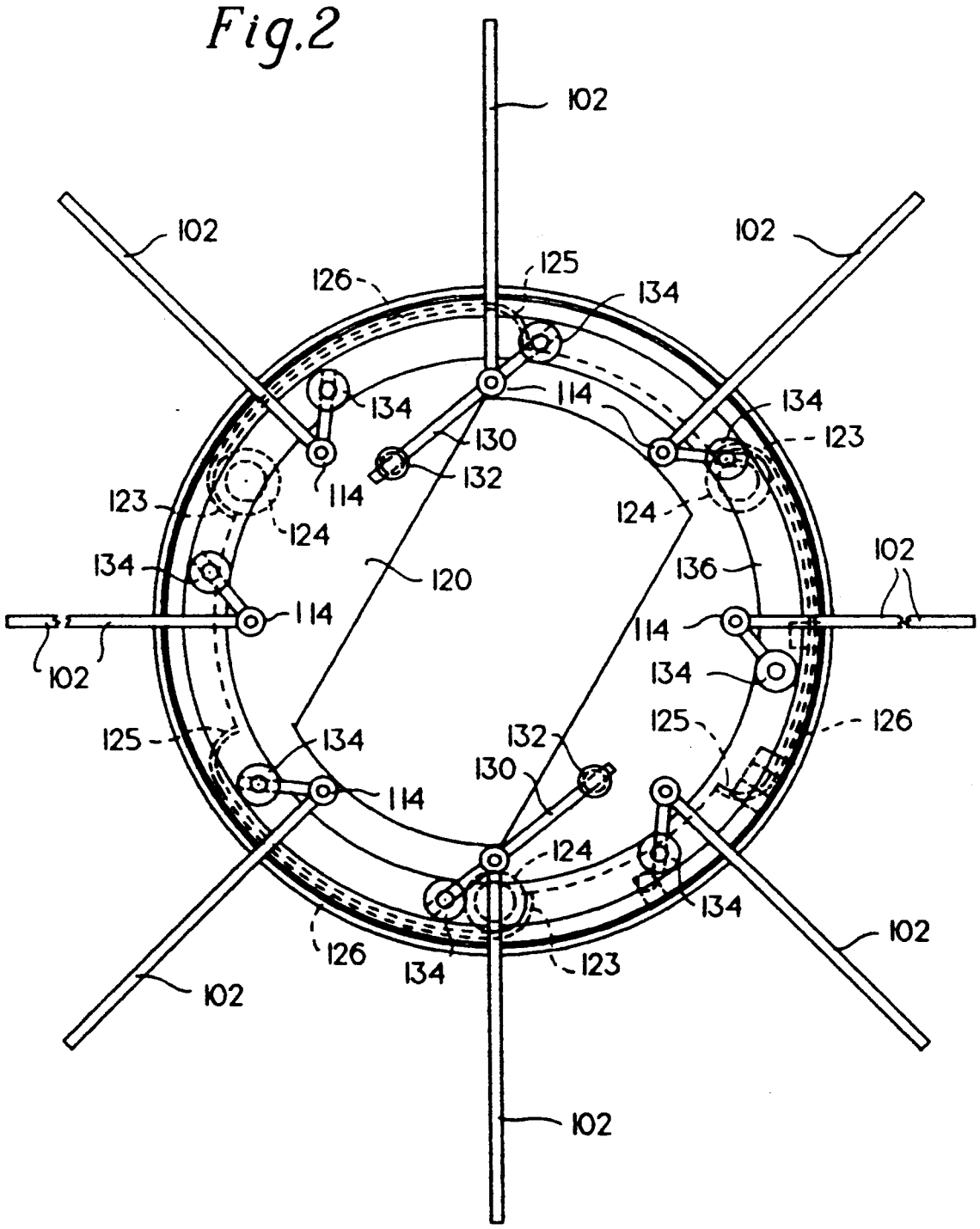
FIG. 2 is a top plan view of a preferred embodiment of the pattern change mechanism of the present invention in the fully open, large pattern position.
Figure 3:
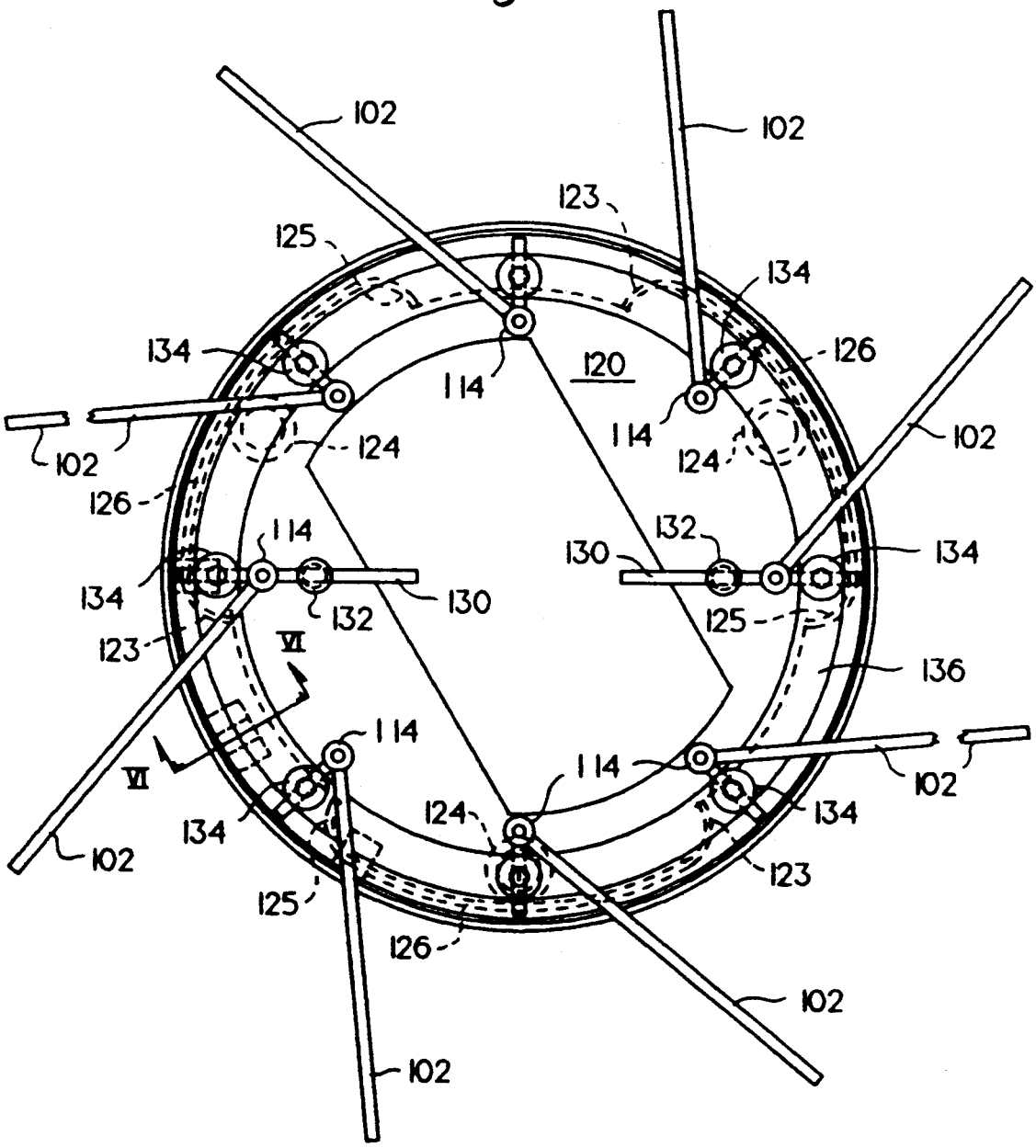
FIG. 3 is a top plan view of the pattern change mechanism of FIG. 2 in the middle pattern position.
Figure 4:
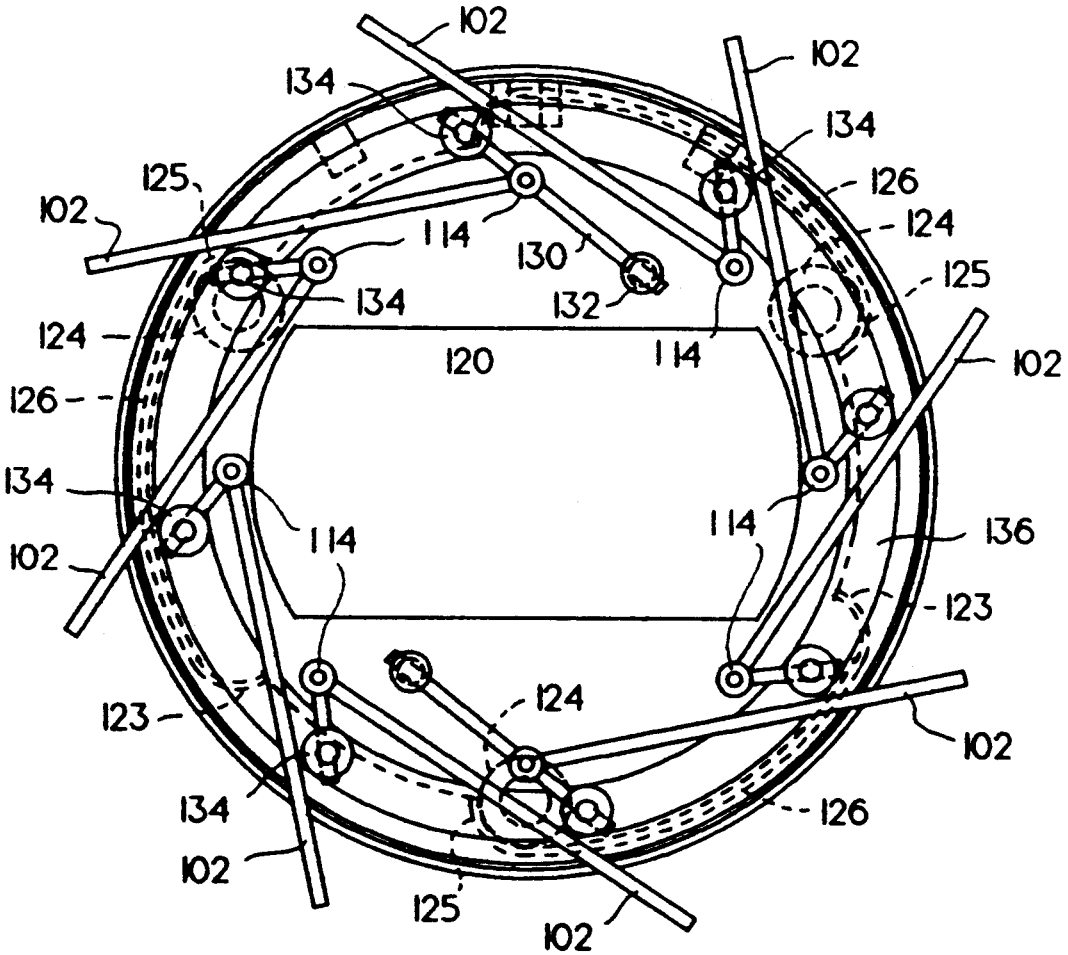
FIG. 4 is a top plan view of the pattern change mechanism of FIG. 2 in the fully closed small pattern position.

The vee-bearings 124 ride along paths in track 126. As shown in FIG. 2, when the flags 102 are in the fully open, first position, vee-bearings 124 are at the first end 123 of the path. As shown in FIG. 3, when the flags 102 are in the second position, the vee-bearings 124 are midway between ends 123 and 125. When the flags 102 are in the third position, as shown in FIG. 4, the vee-bearings 124 are at the second end 125. The track 126 and vee-bearings 124 thus provide a limit to the degrees of rotation of rotation plate 120. In the preferred embodiment, the angle of rotation is about 60°.

Reflector 14 superposes lamp 12. It is designed to collect the light from lamp 12 and direct it in a substantially collimated manner onto refractor 18. A preferred embodiment of reflector 14 for surgical use has about a 22 ¼ diameter and 7 ¼ height. The reflector 14 is preferably an injection molded plastic, generally parabolic member which partially circumscribes, and is radially spaced from, lamp 12 and the axis of symmetry of lighting fixture 10. The reflector 14 is coated on its interior surface with a color correcting, cold mirror dichroic film which reflects visible energy onto the refractor 18 and selectively absorbs/transmits part of the visible light spectrum through the coating and reflector 18 to change the color temperature of the light, preferably from about 3250° K. to approximately 4200° K.

Figure 7:
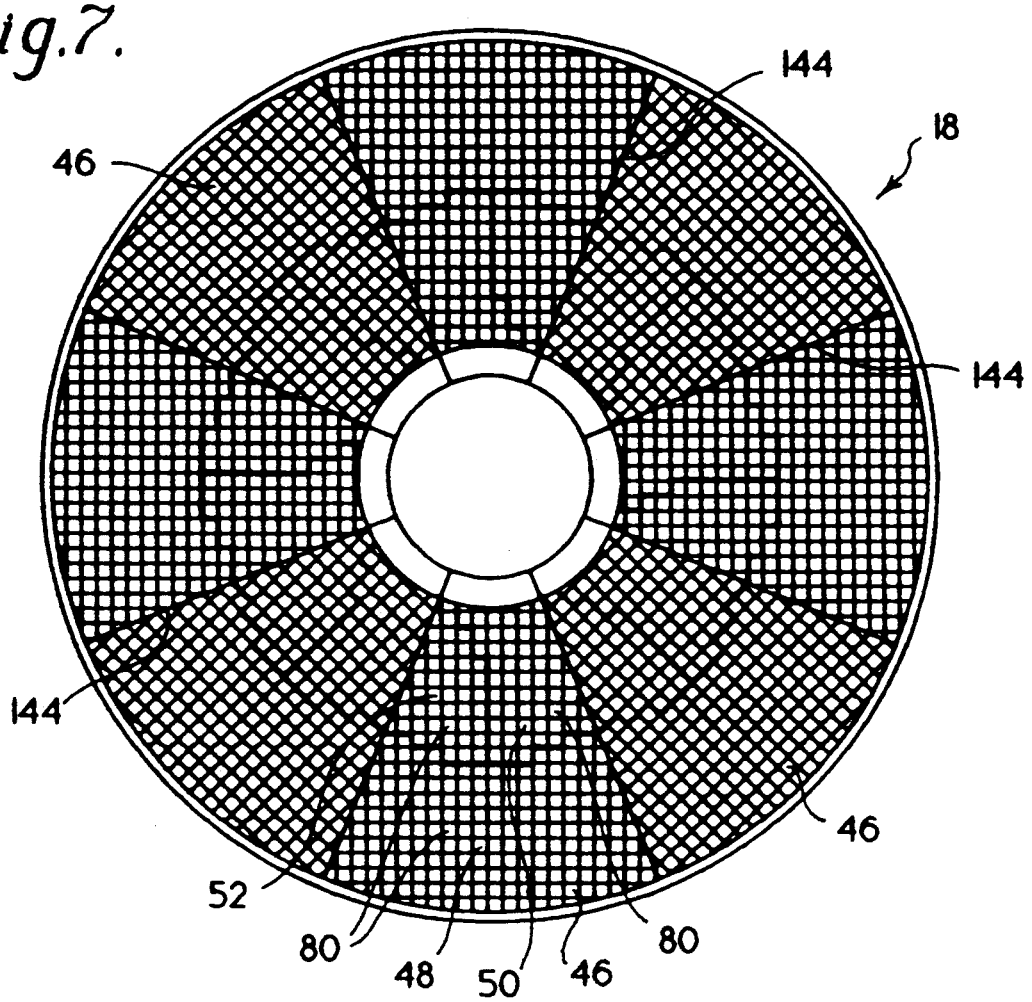
FIG. 7 is a top plan view of the refractor in the lighting fixture of FIG. 1.

Refractor 18, as shown in FIG. 7, is divided into eight equal adjacent, preferably wedge-shaped, portions 46 which radiate outwardly relative to the axis of symmetry of the lighting fixture 10. Each portion is optically identical to each of the other portions.

Referring again to FIG. 7, each portion 46 includes a first set of refractive prisms 48 for providing a small pattern of light on a target surface, a second set of refractive prisms 50 for providing in conjunction with the first set of prisms 48 a medium pattern of light on a target surface and a third set of refractive prisms 52 for providing, in conjunction with the first and second sets of prisms 48, 50, a large pattern of light on a target surface. First and second prism sets 48 and 50 are preferably further divided into a plurality of different segments. Each of the prism sets, 48, 50 and 52, and each segment within a prism set are comprised of a plurality of individual prism members 80. In the preferred embodiment of refractor 18, there are 806 individual prisms 80 in each portion 46. The prisms 80 are of varying configuration from prism set to prism set and among the different segments within a prism set.

The light emitted from lamp 12 passes through filter 16 and is received by, or intersected by, reflector 14. Reflector 14 collects the light from lamp 12 and directs it, preferably in a collimated manner, onto refractor 18.

Figure 8:
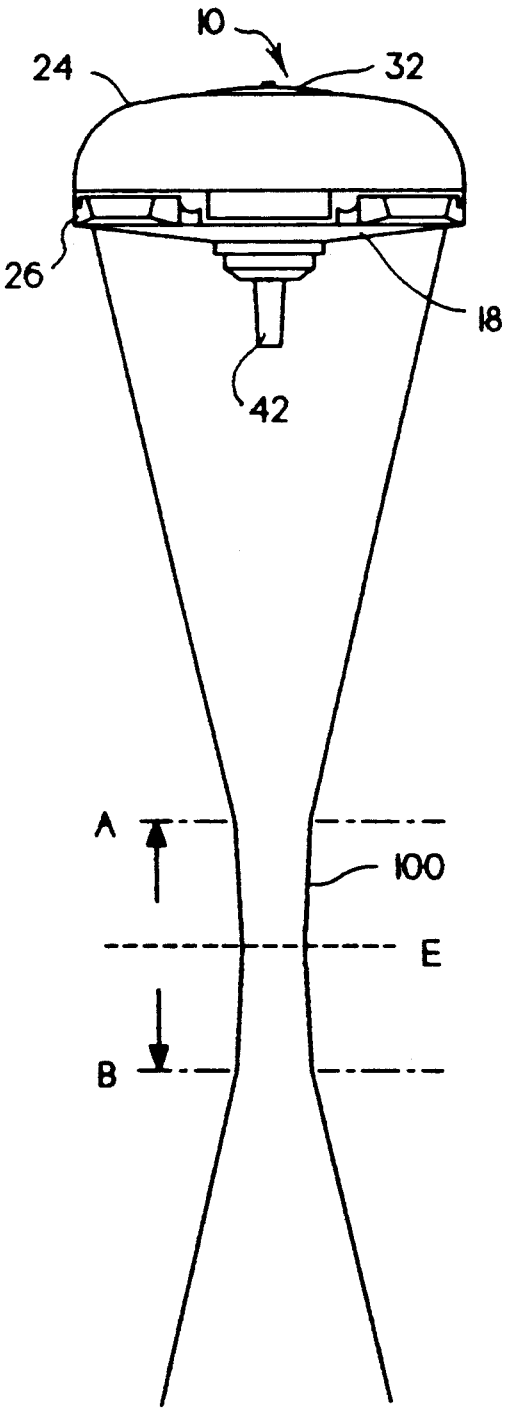
FIG. 8 is a view of the pattern of light obtained when the pattern change mechanism is in the position of FIG. 4.
Figure 9:
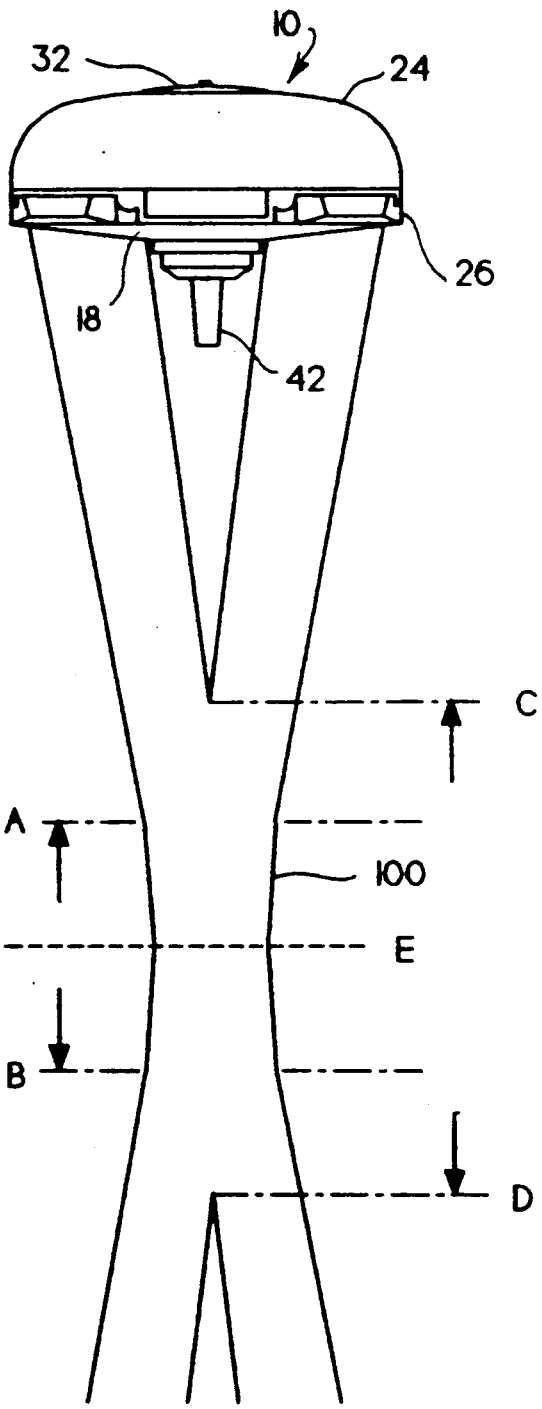
FIG. 9 is a view of the pattern of light obtained when the pattern change mechanism is in the position of FIG. 3.

Each set of prisms, 48, 50 and 52, and each segment within a set of prisms specifically directs the light to specific areas within a cylinder of light 100 defined by the light emitted from lighting fixture 10. The cylinder of light 100 is relatively long (16–18 inches) in the preferred embodiment of lighting fixture 10, starting at a distance of about 36 inches from refractor 18. The cross section of the areas within the cylinder of light 100 define small, medium and large pattern sizes, preferably about 4, 6 and 8 inches in diameter, respectively. Referring to FIGS. 8 and 9, the cylinder of light 100 is of slightly varying cross section throughout its length. The term "cylinder of light," as used herein will refer to a cylinder of the type generally shown in the drawings wherein the diameter throughout the length of the cylinder varies by about +10%. FIG. 8 shows the small pattern projection of light. FIG. 9 shows the medium pattern projection of light. The length of the cylinder of light 100 is substantially constant from pattern to pattern as shown by the distances indicated between lines A and B in FIGS. 8 and 9. The cylinder of light 100 lies within the total depth of field of the optical system, shown in FIG. 9 as the distance between lines C and D. The depth of field is the total distance where there is a useful light pattern without a dark hole developing in the pattern. It ranges from 21–24 inches in length. The focal plane, indicated at line E, corresponds to the preferred location of the target surface. The target surface may be any work surface, such as a surgical site, and is preferably about 44 inches from refractor 18.

Figure 10:
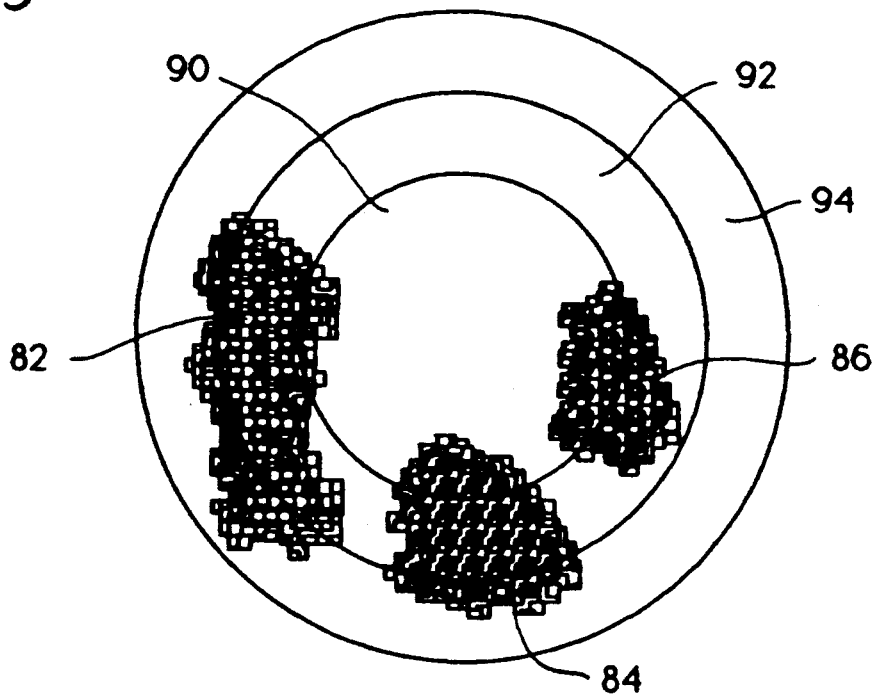
FIG. 10 is a view of the areas of impingement on a target surface of light passed through areas of the refractor of FIG. 7 and the relative diameters of the small, medium and large pattern of light created when the pattern change mechanism of the present invention is in the positions shown in FIGS. 4, 3 and 2, respectively.

Referring to FIG. 10, the three pattern sizes are shown in cross section as they would impinge the target surface by first, second and third diameters 90, 92 and 94 of the cylinder of light 100. The overlapping equal section areas 82 correspond to light focused onto the target surface by one third prism set 52 of one portion 46, when the target surface is about 44 inches from the refractor 18. The overlapping square section areas 84 and 86 correspond to light focused onto the target surface at the same target distance by two segments of one second prism set 50 of one portion 46. Similar square section areas (not shown) corresponding to light focused onto the target surface within the first, or small diameter 90 of the cylinder of light 100 would also occur. When similar areas of impinging light are superimposed on the target surface for each of the eight portions 46 of refractor 18, a smooth blended pattern of light is provided.

The small pattern area defined by first prism set 48 is located at the extreme outer area of refractor 18. This arrangement gives the maximum possible shadow reduction performance for any of the three patterns. The second and third prism sets 50 and 52, for the medium and large patterns, respectively, are designed to simply add light to the small pattern's outer diameter 90 to increase the size of the pattern as shown in FIG. 10 to diameters 92 and 94. Each flag 102 is aligned when in the fully open position shown in FIG. 2 with the line of intersection 144 between adjacent portions 46 of refractor 18 and lie in a plane which passes through the associated line of intersection 144.

The flags 102 are movable in synchronization and, preferably in gradual degrees, to a first, fully open position as shown in FIG. 2, in which light passing through the first, second and third prism sets, 48, 50, 52, respectively, is not blocked to permit the cylinder of light 100 to assume the large pattern shown by diameter 94 in FIG. 10. The flags 102 are also movable, in synchronization and preferably in gradual degrees, to a second position in which light passing through the third set of prisms 52 is gradually blocked to gradually reduce the pattern on the target surface to medium as shown by diameter 92 in FIG. 10. The flags 102 are also movable, in synchronization and preferably in gradual degrees, to a third position in which the light passing through the second and third sets of prisms, 50 and 52, is gradually blocked to gradually reduce the pattern produced by the diameter of the cylinder of light 100 to the small pattern as shown by diameter 90 of FIG. 10.

The blocking action of flags 102 does not detrimentally affect the optical performance characteristic of the system in any significant aspect. The cylinder of light 100 remains at the desired distance from lighting fixture 100 in all three pattern sizes. In each pattern size, the peak illuminance remains constant. Also in the total cylinder of light 100 from top to bottom, as shown in FIGS. 8 and 9, the peak illuminance remains relatively constant, varying only about ±10% for each pattern size.

The pattern change mechanism 110 of the present invention provides a direct drive mechanism from the handle 22 to the blocking flags 102 for selectively controlling the size of light distribution at a target site within a predetermined range of sizes without altering the quality of the light. Certain angles of the light field from lamp 12 can be selectively blocked by a simple mechanism which can be operated by the user and thereby add great procedural flexibility to the lighting fixture 10.

We claim:

1. Apparatus for changing the size distribution of light emitted from a lighting fixture having a light source and a reflector superposing the light source in a partially circumscribing radially spaced relationship relative to the axis of symmetry of the lighting fixture for intersecting light radiating from the light source and directing the light toward a target surface, said apparatus comprising:

means for blocking light directed toward a target surface;

means for moving said blocking means into at least a first position and a second position, wherein, in said first position, no light is blocked to produce a first pattern of light distribution having a peak illuminance, and wherein, in said second position, a first portion of light directed toward the target surface is blocked to produce a second pattern of light distribution smaller than said first pattern such that said peak illuminance remains relatively constant.

2. The apparatus recited in claim 1 wherein said moving means is structured to move said blocking means into a third position wherein a second portion of light directed toward the target surface, greater than said first portion of light, is blocked to produce a third pattern of light distribution smaller than said second pattern such that said peak illuminance remains relatively constant.

3. The apparatus recited in claim 2 wherein said blocking means is movable among said first, second and third positions in gradual degrees to produce gradually changing patterns of light distribution within a range of patterns from said first pattern to said third pattern.

4. The apparatus recited in claim 2 wherein said moving means comprises:

a rotation member;

drive means operatively connected to said rotation member;

actuator means operatively linked to said blocking means and configured for sliding cooperation with said drive means, said rotation member being configured to slidably receive said actuator means;

means for rotating said rotation member such that said rotation member effects the movement of said drive means and said drive means effects the sliding movement of said actuator means relative to said rotation member to selectively move said blocking means into one of said first, second and third positions.

5. The apparatus recited in claim 4 wherein said moving means further comprises means for limiting the angle through which said rotation member can rotate.

6. Apparatus for changing the size distribution of light emitted from a lighting fixture comprising:

means for blocking light directed toward a target surface;

a rotation member;

drive means operatively connected to said rotation member;

actuator means operatively linked to said blocking means and configured for sliding cooperation with said drive means, said rotation member being configured to slidably receive said actuator means;

means for rotating said rotation member such that said rotation member effects to movement of said drive means and said drive means effects the sliding movement of said actuator means relative to said rotation member to move said blocking means into at least a first position and a second position, wherein, in said first position, said blocking means do not block light to produce a first pattern of light distribution having a peak illuminance, and wherein, in said second position, said blocking means blocks a first portion of light directed toward the target surface to produce a second pattern of light distribution smaller than said first pattern such that said peak illuminance remains relatively constant.

7. Apparatus as recited in claim 6 wherein said blocking means is comprised of a plurality of blocking members, each said blocking member being linked by means of a guide member to said actuator means.

8. Apparatus as recited in claim 7 wherein said actuator means comprises a plurality of actuator members, each said actuator member being operatively connected to one of said plurality of blocking members by one said guide member and said plurality of actuator members being linked to each other by a linking member, such that movement of one of said plurality of actuator members moves all of said actuator members, each of which in turn moves the one of said blocking members to which such actuator member is operatively connected in a synchronized manner.

9. Apparatus as recited in claim 7 wherein said drive means comprises two actuator drive members connected to said rotation member, each said actuator drive member being operatively connected by means of said actuator means to one of said plurality of said blocking members.

10. Apparatus as recited in claim 6 further comprising means for limiting the angle through which said rotation member can rotate.

11. Apparatus as recited in claim 10 wherein said limiting means comprises bearing means operatively connected to said rotation member and track means for slidably mounting said bearing means, said track means defining a path having first and second ends along which said bearing means travels when said rotation member is prevented from further rotation in a given direction when said bearing means reaches one of said first or second ends of said path.

12. Apparatus as recited in claim 11 wherein, when said blocking means is in said first position, said bearing means is positioned at said first end of said path and, when said blocking means is in said second position, said bearing means is positioned at a point along said path.

13. Apparatus as recited in claim 12 wherein said actuator means is movable relative to said rotation member to move said blocking means into a third position wherein said blocking means blocks a third portion of light directed toward the target surface to produce a third pattern of light distribution smaller than said second pattern and, when said blocking means is in said third position, said bearing means is positioned at the said second end of said path.

14. Apparatus as recited in claim 6 wherein said actuator means is movable relative to said rotation member to move said blocking means into a third position wherein said blocking means blocks a third portion of light directed toward the target surface to produce a third pattern of light distribution smaller than said second pattern.

15. Apparatus as recited in claim 14 further comprising means for selecting locking said blocking means in one of said first, second or third positions.

16. Apparatus as recited in claim 14 wherein said blocking means is movable among said first, second and third positions in gradual degrees to produce gradually changing patterns of light distribution within a range of patterns from said first pattern to said third pattern.

17. Apparatus as recited in claim 6 wherein said rotating means is a rotatable handle operatively connected to said rotation member.

18. Apparatus as recited in claim 6 wherein said lighting fixture comprises:

a light source for emitting light;

a reflector superposing said light source in a partially circumscribing radially spaced relationship relative to an axis of symmetry of said lighting fixture for receiving the light emitted from said light source and directing such received light towards a target surface; and a refractor through which the light directed by said reflector towards said target surface passes, said refractor having a plurality of first, second and third prism means for focusing the light passed therethrough, said first prism means being configured to focus the light to define a cylinder of light coaxial to said axis of symmetry having a diameter corresponding to said third pattern, said second prism means being configured to focus the light to increase the diameter of said cylinder of light to correspond to said second pattern and said third prism means being configured to focus the light to increase the diameter of said cylinder of light to correspond to said first pattern, when said blocking means is positioned in said third, second and first positions, respectively.

19. Apparatus as recited in claim 18 wherein said refractor is divided into a plurality of substantially equal adjacent portions which radiate outwardly relative to said axis of symmetry and define between each adjacent portion a line of intersection; and said blocking means is comprised of a plurality of blocking members radiating outwardly relative to said axis of symmetry, said plurality of blocking members being aligned above said refractor such that a different one of said plurality of blocking members is aligned above, and lies in the same plane as, each of said lines of intersection formed between adjacent portions of said refractor when said blocking means is in said first position and said plurality of blocking members being aligned above said refractor such that a different one of said plurality of blocking members is aligned at an angle relative to each of said lines of intersection when said blocking means is in either one of said second and third positions thereby blocking light from passing through selected areas of each portion of said refractor.

* * * * *

UNITED STATES PATENT AND TRADEMARK OFFICE

CERTIFICATE OF CORRECTION

PATENT NO. : 5,067,064
DATED : November 19, 1991
INVENTOR(S) : Joel C. Gehly, David Zolner and James Szumigala It is certified that error appears in the above-identified patent and that said Letters Patent is hereby corrected as shown below:

Col. 1, line 30, delete "event" and substitute --evenly-- therefor.

Col. 1, line 32, delete "product" and substitute --produce-- therefor.

Col. 1, line 38, delete "The" and substitute --To-- therefor.

Col. 5, line 19, delete "22¼ diameter and 7¼ height" and substitute --22¼ "diameter and 7¼" height-- therefor.

Col. 6, line 3, delete "+10%" and substitute --± 10%-- therefor.

Col. 7, line 3, delete "100" and substitute --10-- therefor.

UNITED STATES PATENT AND TRADEMARK OFFICE

CERTIFICATE OF CORRECTION

PATENT NO. : 5,067,064

DATED : November 19, 1991

INVENTOR(S) : Joel C. Gehly, et al.

It is certified that error appears in the above-identified patent and that said Letters Patent is hereby corrected as shown below:

Column 9, line 18, delete "selecting" and insert --selectively--.

Signed and Sealed this

Fourth Day of May, 1993

*Attest:*

Michael K. Kirk

MICHAEL K. KIRK

*Attesting Officer*

*Acting Commissioner of Patents and Trademarks*